United States Patent [19]

Morohashi et al.

[11] Patent Number: 4,986,316

[45] Date of Patent: Jan. 22, 1991

[54] PACKAGE FEED FOR A PRESCRIBED WEFT LENGTH OF CARBON FIBER

[75] Inventors: Kazuo Morohashi, Yokohama; Masayoshi Kawasaki, Kawasaki; Kazuo Tsukabayashi; Saburo Hamade, both of Kanazawa, all of Japan

[73] Assignees: Ishikawa Prefecture, Kanazawa; Nippon Oil Company, Ltd., Tokyo, both of Japan

[21] Appl. No.: 406,242

[22] Filed: Sep. 12, 1989

[30] Foreign Application Priority Data

Sep. 12, 1988 [JP] Japan ..... 63-226417

[51] Int. Cl.[5] ..... D03D 47/34

[52] U.S. Cl. ..... 139/452; 139/370.2; 242/47.01

[58] Field of Search ..... 139/435.1, 452, 370.2; 242/47.01

[56] References Cited

U.S. PATENT DOCUMENTS

| | | | |
|---|---|---|---|
| Re. 30,318 | 7/1980 | Klinecky et al. | 139/452 |
| 2,673,576 | 3/1954 | Dawas | 139/452 |
| 3,914,494 | 10/1975 | Park | 139/420 C |
| 4,090,536 | 5/1978 | Van Mullekoni | 139/452 |
| 4,617,971 | 10/1986 | Hellstroem | 139/370.2 |
| 4,730,645 | 3/1988 | Baird et al. | 139/452 X |

*Primary Examiner*—Andrew M. Falik

*Attorney, Agent, or Firm*—Oblon, Spivak, McClelland, Maier & Neustadt

[57] ABSTRACT

A method and apparatus for feeding a weft to weave a carbon fiber fabric. A carbon fiber package is supported rotatably in such a manner that the axis of the shaft thereof is substantially perpendicular to the running direction of the carbon fiber. The package is rotated so as to deliver the carbon fiber of a prescribed length necessary for one shot weaving of the weft. The carbon fiber of the prescribed length is reserved in a reservoir under an adjusted constant tension before shooting the carbon fiber weft of the prescribed length.

8 Claims, 3 Drawing Sheets

PACKAGE FEED FOR A PRESCRIBED WEFT LENGTH OF CARBON FIBER

FIELD OF THE INVENTION

This invention relates to a method and an apparatus for feeding a weft to a weft supplying system when a carbon fiber fabric is woven.

BACKGROUND OF THE INVENTION

In the conventional method for feeding a weft to weave a carbon fiber fabric, as represented in FIG. 3, a cheese package 22 of a carbon fiber 21 is mounted in such a manner that the axis of the shaft 22*a* of the package 22 coincides with the running direction (indicated by arrow X in FIG. 3) of a weft, and the weft is shot between warps 24 by a weft supplying system.

In the above-described method, there are the problems that (1) the carbon fiber fed out from the cheese package often comes in contact with the remainder of the carbon fiber wound on the package and is thereby damaged, (2) the tension which acts on the carbon fiber varies when the fiber is fed out from the package by the weft supplying system, and (3) since the carbon fiber is delivered in the axial direction of the shaft 22*a* of the cheese package 22, the tow is twisted.

SUMMARY OF THE INVENTION

One object of the present invention is to provide a method and an apparatus for feeding a carbon fiber of a prescribed length exactly equal to the length necessary for one shot weaving of a weft or a length necessary for one weft insertion in advance of every shot thereof from the package of the fiber, in such a manner that, while the carbon fiber weft is woven, neither the fiber is damaged, nor the tow is twisted.

Another object of the present invention is to provide a method and an apparatus for shooting said carbon fiber weft of said prescribed length under an adjusted constant tension.

A further object of the present invention is to provide a method and an apparatus capable of stopping the loom automatically to avoid waste of the carbon fiber when the fiber breaks or when the fiber in the package runs out.

In order to realize the above-listed objects, the method for feeding a weft to weave a carbon fiber fabric according to the present invention comprises the steps of supporting a carbon fiber package rotatably in such a manner that the axis of the shaft thereof is substantially perpendicular to the running direction of said carbon fiber; causing said package to rotate so that said carbon fiber of a prescribed length necessary for one shot weaving of said weft is fed out; reserving said carbon fiber of said prescribed length in a reservoir; and shooting said carbon fiber weft of said prescribed length.

The method according to the present invention also comprises the steps of detecting said carbon fiber reserved in said reservoir to be of a prescribed length necessary for one shot weaving of said weft and stopping rotating said package automatically.

The method according to the present invention further comprises the step of applying an adjusted constant tension to said carbon fiber while said carbon fiber weft is shot.

The method according to the present invention further comprises the steps of detecting breaks in said carbon fiber or running out of said carbon fiber of said package and stopping the loom automatically.

The apparatus for feeding a weft to weave a carbon fiber texture according to the present invention comprises a carbon fiber package supported in such a manner that the axis of the shaft thereof directs substantially perpendicular to the running direction of the carbon fiber; driving means for causing said package to rotate so as to feed out said carbon fiber of a prescribed length necessary for one shot weaving of said weft; a reservoir for reserving said carbon fiber of said prescribed length in advance of shooting said weft; and means for applying tension to the reserved carbon fiber.

The apparatus according to the present invention also comprises a first detecting means for detecting the carbon fiber reserved in said reservoir to be of said prescribed length necessary for one shot weaving of said weft and outputting a control signal to said driving means to stop rotating said package automatically.

Further, said means for applying tension includes slider means which adjusts the tension applied to said reserved carbon fiber while said weft of said carbon fiber is shot.

The apparatus according to the present invention, further comprises a second detecting means for detecting breaks in said carbon fiber or running out of said carbon fiber in said package and generating a control signal to stop the loom automatically.

In operation, since the carbon fiber is fed out in the same direction as its running direction as the package rotates, the fiber is delivered to the reservoir without undergoing unnecessary stress. Whenever the length of the carbon fiber delivered to and reserved in the reservoir reaches the prescribed value necessary for one shot weaving of a weft, rotation of the package is stopped and the reserved carbon fiber of the prescribed length is shot between the warps on weaving by the weft supplying system. Although the carbon fiber is pulled during the shot and is subjected to a tensile force, the magnitude of the tension applied to the carbon fiber is adjusted by the load of the slider means which can be provided in the reservoir, the load providing a constant and unvarying tension.

Whenever it is detected that the carbon fiber of the prescribed length necessary for one shot weaving of a weft is reserved in the reservoir, the rotation of the package is controlled to stop automatically, thereby preventing the carbon fiber between the package and the reservoir from slackening during weaving.

Further, whenever breaks in the carbon fiber, or running out of the carbon fiber in the package is detected, the loom is stopped automatically, thereby preventing waste of the carbon fiber.

DETAILED DESCRIPTION OF THE PREFERRED EMBODIMENT

Figure 1:
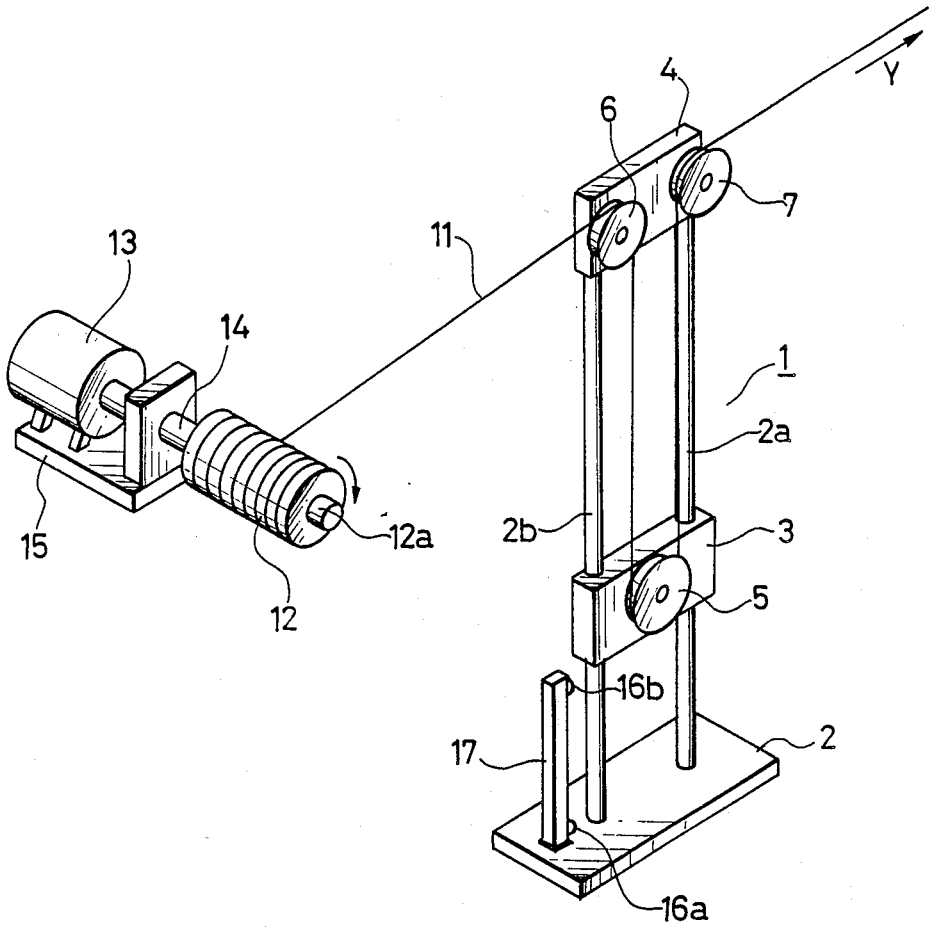
FIG. 1 represents an oblique projection view showing the outline of the apparatus for feeding a weft to weave a carbon fiber fabric according to the present invention, FIG. 2 a side view of the principal part of the reservoir shown in FIG. 1, and FIG. 3 an oblique projection view showing the outline of the conventional apparatus for feeding a weft.

Referring to the drawings, we will now describe a preferred embodiment of the present invention.

FIG. 1 shows the apparatus for feeding a weft according to the present invention. The reservoir is indicated overall by reference number 1, wherein a headpiece 4 is provided between the upper ends of two supporting rods 2a, 2b installed upright on a base 2. A guide pulley 6 and a draw-out pulley 7 are provided rotatably between both ends of the headpiece 4. A slider 3 is up- and downwardly movably adapted to said supporting rods 2a, 2b. A side pulley 5 is supported rotatably in the middle of said slider 3. A driving motor 13 is mounted on a base 15 located appropriately distant from said reservoir 1. A shaft 12a of a package 12 of carbon fiber 11, which is rotated by said driving motor 13, is directed substantially perpendicular to the running direction of said carbon fiber 11. FIG. 1 represents an example of a shaft 12a connected directly to a shaft 14 of said driving motor 13, wherein both said shaft 14 of said driving motor 13 and said shaft 12a of said package 12 are arranged so as to be directed substantially perpendicular to the running direction of said carbon fiber 11.

Figure 2:
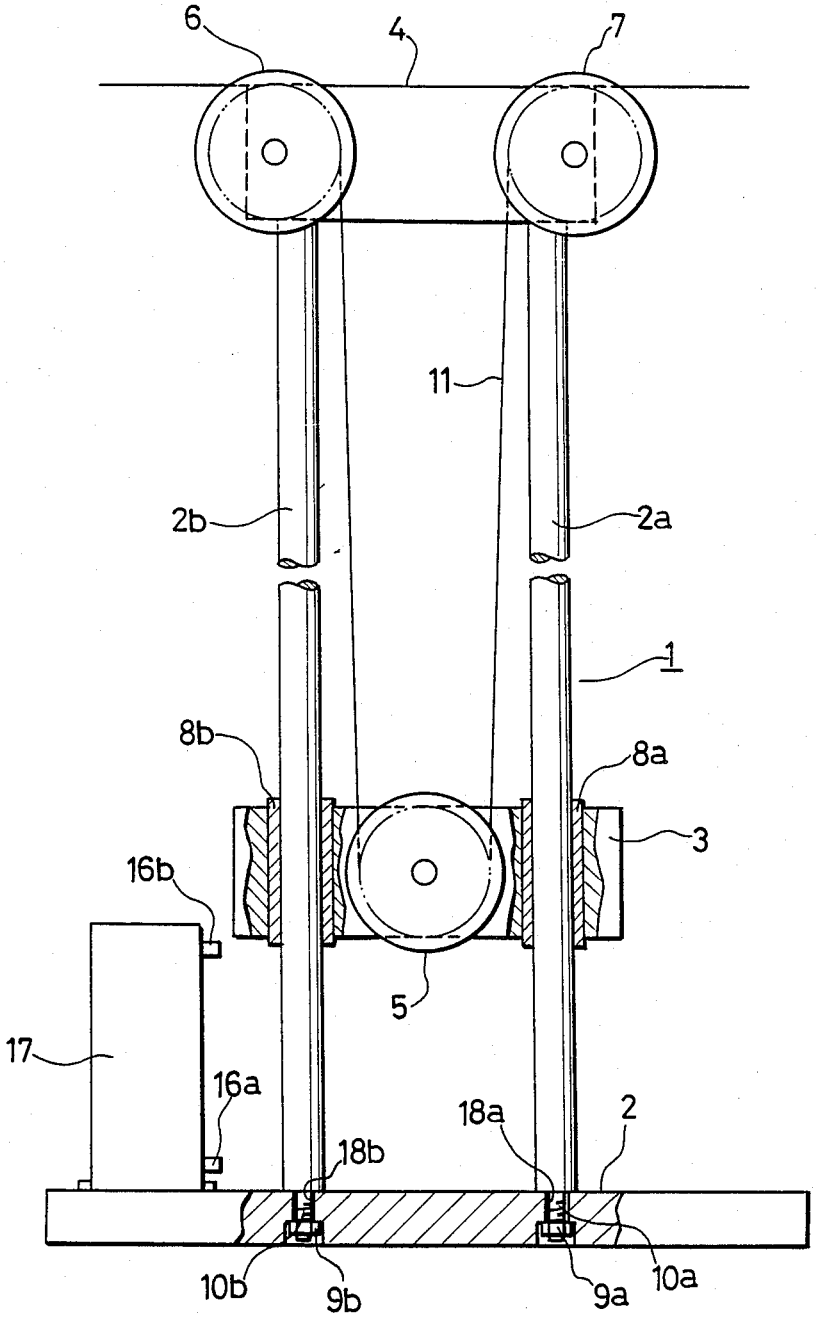
Figure 3:
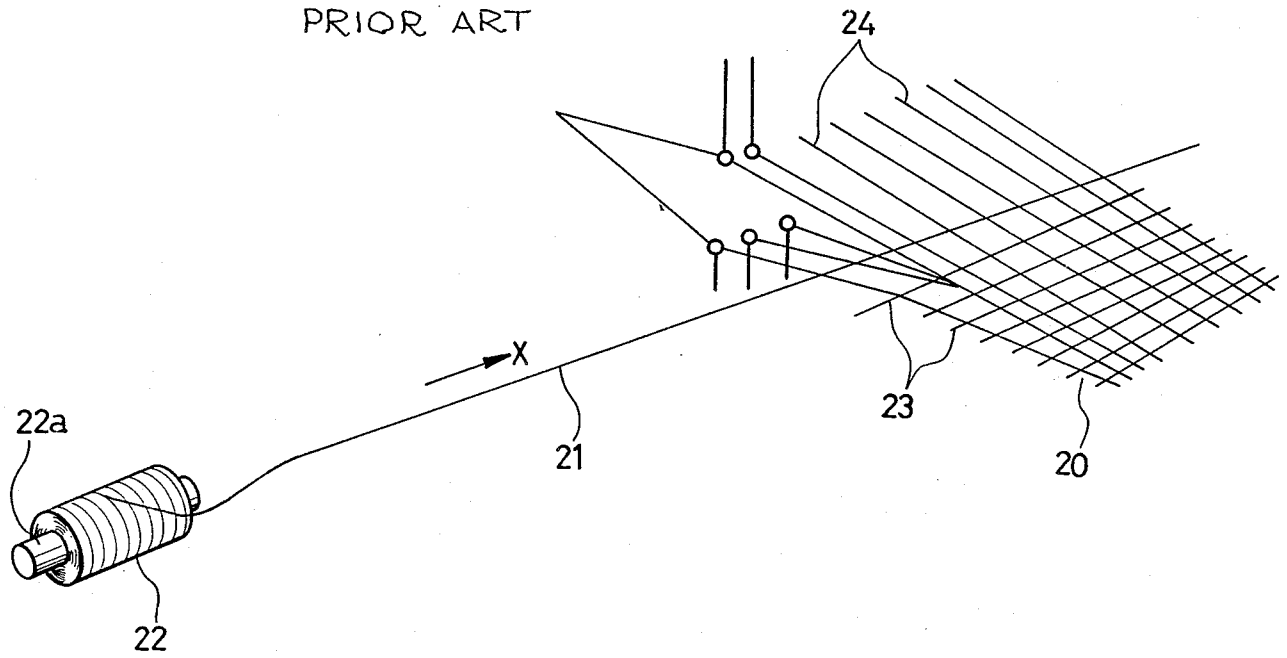
FIG. 3 PRIOR ART

As shown in detail in FIG. 2, said supporting rods 2a, 2b are secured to said base 2 by screw nuts 9a, 9b onto screws 10a, 10b, respectively, which are threaded on the lower part of said supporting rods 2a, 2b and passed through two fixing holes 18a, 8b bored in said base 2. Bushes 8a 8b of said slider 3 can be of a self-lubricating material. Further, at an appropriate position on said base 2, there is provided a case 17, in which upper and lower detectors 16b, 16a, each including a photoelectric tube, limit switches, and other components, are mounted. Said upper detector 16b (not shown in detail) is constituted in such a manner that, when it detects a prescribed descending position of said slider 3, said driving motor 13 is controlled to stop rotation. Similarly, said lower detector 16a is constituted in such a manner that, when it detects another prescribed descending position of said slider 3, the loom is controlled to stop rotation.

We will next explain the operation of the apparatus shown in FIG. 1.

Prior to weaving, said package 12 of said carbon fiber 11 is secured to said shaft 14 of said driving motor 13, said carbon fiber 11 is suspended on said guide pulley 6, said slide pulley 5 and said draw-out pulley 7 successively. The leading end of said carbon fiber 11 is grasped by a weft supplying system of a rapier loom to apply a tension to the weft, thereby getting ready for shooting a weft. At this stage, said slider 3 ascends near said headpiece 4.

When said driving motor 13 is started up, said package 12 is rotated and said carbon fiber 11 is fed out, said slider 3, guided by two supporting rods 2a, 2b, descends by its own weight. When the bottom of said slider 3 descends to the prescribed position, said driving motor 13 is controlled to stop by the control signal delivered from said upper detector 16b. This prescribed descending position (hereafter, referred to as the first descending position) is determined so that the length of the said carbon fiber 11 suspended between said guide pulley 6 and said draw-out pulley 7 via said slide pulley 5 corresponds to the length necessary for one shot weaving of a weft. Next, the weft is shot between the warps by the weft supplying system (not shown). This causes said carbon fiber 11 to be pulled in the direction indicated by Y by a tensile force, whereby said slider 3 ascends to the vicinity of the bottom of said headpiece 4 by means of said slide pulley 5 around which said carbon fiber 11 is wound. Since the tension acting on said carbon fiber 11 during the shot of the weft is caused only by the load of said slider 3, it does not vary. When weaving a weft starts, and said slider 3 leaves the first descending position, said driving motor 13 rotates and said carbon fiber 11 is fed out from said package 12. When the weaving of the weft ends, said slider 3 descends, and said carbon fiber 11 of the prescribed length necessary for one shot weaving is reserved in said reservoir 1. After this, the above operation is repeated, and said carbon fiber 11 of the prescribed length necessary for one shot weaving of the weft reserved in said reservoir 1 is shot by means of the weft supplying system repeatedly.

In order to detect said carbon fiber 11 of said prescribed length corresponding to one shot weaving of the weft to be reserved in said reservoir, said upper detector 16b detects said first descending position of said slider 3, and, when said slider 3 descends to said first descending position, generates a control signal to stop said driving motor 13 automatically, thereby stopping feeding out of said carbon fiber 11 from said package 12.

Further, since breaks in said carbon fiber 11 and running out of said carbon fiber 11 in said package 12 cause said slider 3 to descend on said base 2 (hereafter referred to as the second descending position), said detector 16a detects the position of said slider 3. When said slider 3 reaches the second descending position, detector 16b generates a control signal to stop the loom, thereby preventing waste of carbon fiber 11, for example when it breaks.

Next, experimental results of an example (Example A) of the present invention and a comparative example are presented.

EXAMPLE A

Procedures: Photoelectric switches (Model E3F, DS10Z1; Omron Tateisi Electronics Co., Ltd.) were used as detectors 16a, 16b, and a speed control pulley motor (Model 4IK25 RGN-A; Oriental K.K.) was used as driving motor 13 for delivering carbon fiber. Further, package 12 (Model Toreka M40 (3K, 1 Kg) wound; Toray Industries, Inc.) was used as carbon fiber 11. The axis of shaft 12a of package 12 was directed substantially perpendicular to the running direction of the carbon fiber.

Result: A plain weave of 1 m width was woven. No twist was observed at all in tows with the shot weft. No damage was found on the surface of the carbon fiber by microscopic observation.

COMPARATIVE EXAMPLE

Procedures: Weaving was carried out under the same conditions as in Example A except for longitudinal feed out of the carbon fiber from the package, i.e., feed out in which the package shaft was directed parallel to the running direction of the carbon fiber.

Result: At the initial stage of the package (the outer diameter of the carbon fiber roll was about 16 cm), tow twist was generated about two times per 1 m of the weft. At the final stage of the package (the outer diameter of the carbon fiber roll was about 8 cm), tow twist was generated about four times per 1 m of the weft. Further, in the woven plain weave, a twist defect (a striped pattern) was generated. Minor damage was found on the surface of the carbon fiber by microscopic observation.

In summary, the advantages of the present invention are as follows:

1. Since the carbon fiber fed out from the package does not come in contact with the remainder of the carbon fiber wound on the package, the surface of the carbon fiber is not damaged.

2. Since the carbon fiber is fed out in a direction perpendicular to the axis of the package, it is not twisted.

3. Since the tension applied to the carbon fiber is caused by the load provided in the reservoir, the tension does not vary.

4. Further to the above advantages, the present invention is capable of reserving the carbon fiber of a constant and exact length in the reservoir.

5. The present invention is capable of preventing waste of the carbon fiber by stopping the loom when breaks in the carbon fiber and other eventualities occur.

A preferred embodiment of the invention has been disclosed for illustration purposes only. Many variations and modifications of the disclosed embodiment are believed to be within the spirit of the invention. The following claims are intended to cover the inventive portions of the disclosed embodiment and variations and modifications within the spirit of the invention.

What is claimed is:

1. A method for feeding a weft to weave a carbon fiber fabric, comprising the steps of:

rotatably supporting a carbon fiber package having a shaft, wherein the axis of said shaft is substantially perpendicular to a running direction of said carbon fiber;

rotating said carbon package so that a prescribed length of said carbon fiber necessary for one shot weaving of said weft is fed out;

reserving said carbon fiber having said prescribed length in a reservoir;

detecting said carbon fiber reserved in said reservoir having said prescribed length necessary for one shot weaving of said weft;

stopping rotation of said package automatically when said carbon fiber having said prescribed length is detected in said detecting step; and shooting said weft of said carbon fiber having said prescribed length into a warp shed.

2. A method for feeding a weft to weave a carbon fiber fabric, comprising the steps of:

rotatably supporting a carbon fiber package having a shaft;

rotating said package so that said carbon fiber having a prescribed length necessary for one shot weaving of said weft is fed out;

reserving said carbon fiber having said prescribed length in a reservoir, wherein a running direction of said carbon fiber between said carbon fiber package and said reservoir is substantially perpendicular to the axis of the shaft of said carbon fiber package; and shooting said weft of said carbon fiber having said prescribed length into a warp shed;

wherein said step of reserving said carbon fiber in said reservoir comprises the further step of:

suspending said carbon fiber on a rotatable guide pulley, a slide pulley and a draw-out pulley, said slide pulley descending to a prescribed position when said carbon fiber is fed out, wherein a length of said carbon fiber that is suspended between said guide pulley and said draw-out pulley via said slide pulley corresponds to said prescribed length.

3. A method according to claim 1 or 2, comprising the step of applying an adjusted constant tension to said carbon fiber while said weft of said carbon fiber is shot.

4. A method according to claim 3, further comprising the steps of detecting breaks in said carbon fiber or running out of said carbon fiber in said package and automatically stopping said feeding of said weft to weave said carbon fiber fabric.

5. An apparatus for feeding a weft to weave a carbon fiber fabric comprising:

a carbon fiber package mounted on a shaft, said carbon fiber package and shaft being rotatable, wherein the axis of said shaft is directed substantially perpendicular to a running direction of the carbon fiber;

driving means for causing said package to rotate so as to feed out said carbon fiber of a prescribed length necessary for one shot weaving of said weft;

a reservoir for reserving said carbon fiber of said prescribed length in advance of shooting said weft into a warp shed;

means for applying tension to the reserved carbon fiber; and first detecting means for detecting said carbon fiber reserved in said reservoir to be of said prescribed length necessary for one shot weaving of said weft, said detecting means comprising means for outputting a control signal to said driving means for automatically stopping the rotation of said package.

6. An apparatus according to claim 5, further comprising a second detecting means for detecting breaks in said carbon fiber or running out of said carbon fiber in said package and generating a control signal to automatically stop said apparatus.

7. An apparatus for feeding a weft to weave a carbon fiber fabric comprising:

a carbon fiber package mounted on a shaft, said carbon fiber package and shaft being rotatable;

driving means for causing said package to rotate so as to feed out said carbon fiber of a prescribed length necessary for one shot weaving of said weft;

a reservoir for reserving said carbon fiber of said prescribed length in advance of shooting said weft into a warp shed, wherein a running direction of said carbon fiber between said carbon fiber package and said reservoir is substantially perpendicular to the axis of the shaft of said carbon fiber package; and means for applying tension to the reserved carbon fiber;

wherein said reservoir comprises:

a rotatable guide pulley and draw-out pulley mounted on both ends of a headpiece, said headpiece being supported on first and second supporting rods; and a slide pulley mounted on a slider, said slider being slidably mounted on said first and second supporting rods and being slidable to a prescribed position when said carbon is fed out, said carbon fiber being suspended on said guide pulley, said draw-out pulley and said slide pulley, wherein a length of said carbon fiber that is suspended between said guide pulley and said draw-out pulley via said slide pulley corresponds to said prescribed length.

8. An apparatus according to claim 5 or 7, wherein said means for applying tension includes slider means which adjusts the tension applied to said carbon fiber, while said weft of said carbon fiber is shot.

* * * * *